US007140479B2

(12) United States Patent
Mangano et al.

(10) Patent No.: US 7,140,479 B2
(45) Date of Patent: Nov. 28, 2006

(54) LUGGAGE BAG HAVING A REMOVABLE GARMENT BAG

(75) Inventors: Joy Mangano, St. James, NY (US); Brian Scevola, Palm Harbor, FL (US)

(73) Assignee: Ingenious Designs LLC, Edgewood, NY (US)

( * ) Notice: Subject to any disclaimer, the term of this patent is extended or adjusted under 35 U.S.C. 154(b) by 27 days.

(21) Appl. No.: 10/654,474

(22) Filed: Sep. 3, 2003

(65) Prior Publication Data

US 2005/0045500 A1 Mar. 3, 2005

(51) Int. Cl.
*A45C 5/12* (2006.01)
*A45C 5/14* (2006.01)
*A45C 13/02* (2006.01)
*A45C 13/30* (2006.01)

(52) U.S. Cl. ..... 190/108; 190/18 A; 190/110; 190/901; 206/287.1; 206/288; 211/124

(58) Field of Classification Search ..... 190/18 A, 190/107, 108, 110, 901; 206/278, 279, 286, 206/287, 287.1, 289, 290, 284, 292; 280/37; 246/316.5; 211/124; 248/316.5
See application file for complete search history.

(56) References Cited

U.S. PATENT DOCUMENTS 2,229,182 A * 1/1941 Meyers ..... 211/94.02
2,705,180 A * 3/1955 Enrich ..... 312/3
2,839,167 A * 6/1958 Smith ..... 190/108
3,035,673 A * 5/1962 Schenkler ..... 206/289
3,273,678 A * 9/1966 Koret ..... 190/109
3,437,181 A * 4/1969 Blount, Jr. ..... 190/111
3,542,170 A * 11/1970 Walter ..... 206/279
3,737,013 A * 6/1973 Powell ..... 206/287.1
3,944,032 A * 3/1976 Samhammer et al. ..... 206/292
3,963,102 A 6/1976 Carp
4,206,835 A 6/1980 Shapiro
4,244,453 A 1/1981 Herz
4,436,189 A 3/1984 Baum
4,598,803 A 7/1986 Ghiassi
4,655,343 A * 4/1987 Lane et al. ..... 206/287.1
4,736,854 A * 4/1988 King et al. ..... 211/85.3
4,782,947 A * 11/1988 Sheiman ..... 206/279
4,819,796 A * 4/1989 Gerch et al. ..... 206/291
4,854,431 A 8/1989 Pulichino, Jr. et al.
4,905,826 A * 3/1990 Martin ..... 206/286
4,953,674 A 9/1990 Landes
5,031,766 A * 7/1991 Cohen ..... 206/289
5,150,776 A * 9/1992 Rebenack ..... 190/110
5,180,057 A * 1/1993 Franklin ..... 206/279
5,353,900 A * 10/1994 Stilley ..... 190/18 A
5,394,964 A 3/1995 White
5,431,263 A 7/1995 Nordstrom
5,501,324 A 3/1996 Franklin et al.
5,515,954 A 5/1996 Nordstrom (Continued)

*Primary Examiner*—Sue A. Weaver
(74) *Attorney, Agent, or Firm*—Thomas M. Galgano, Esq.; Galgano & Associates, PLLC

(57) ABSTRACT

A combination garment bag and luggage bag includes a relatively rigid outer luggage bag and a relatively flexible inner garment bag. According to one aspect of the invention, the garment bag is secured to the interior of the luggage bag with the aid of a releasable coupling mechanism. According to another aspect of the invention, the interior of the garment bag is provided with a spring expandable hanger bar. The hanger bar expands when the garment bag is removed from the luggage bag. This allows easier access to the contents of the garment bag.

18 Claims, 13 Drawing Sheets

U.S. PATENT DOCUMENTS 5,566,797 A 10/1996 Van Himbeeck
5,628,443 A * 5/1997 Deutsch ..... 224/583
6,109,402 A 8/2000 Godshaw et al.
6,276,501 B1 * 8/2001 Tong ..... 190/107
6,334,519 B1 * 1/2002 Tong ..... 190/107
6,481,574 B1 * 11/2002 Pakosh ..... 206/285
2002/0027052 A1 * 3/2002 Godshaw et al. ..... 190/111
2002/0195304 A1 * 12/2002 Godshaw ..... 190/111

* cited by examiner

LUGGAGE BAG HAVING A REMOVABLE GARMENT BAG

BACKGROUND OF THE INVENTION

1. Field of the Invention

The invention relates to luggage. More particularly, the invention relates to a luggage bag having a removable garment bag as well as hardware used to contain the garment bag in the luggage bag and to facilitate hanging of the garment bag when removed from the luggage bag.

2. Brief Description of the Prior Art

The packing and carrying of clothes so that they arrive at the destination in a relatively wrinkle-free condition has taxed the ingenuity of people who travel as well as people who design luggage for the people who travel. Attempts to provide wrinkle-free packing having resulted in suitcases or travel containers of a wide variety of designs.

U.S. Pat. No. 4,854,431 to Pulichino, Jr. et al. discloses a suitcase having a compartment for a folded garment bag. The garment bag includes a hangar for hanging when unfolded and VELCRO for keeping it folded when inside the suitcase.

U.S. Pat. No. 4,953,674 to Landes discloses a garment bag apparatus including a pouch for storing a collapsible garment bag carrier when not in use and a garment bag carrier storable within the pouch when not in use with the garment bag carrier including an interior compartment to hold miscellaneous items and a folded garment bag with the garment bag carrier including openings to permit the straps and handles of the garment bag to be extended through the openings so the traveler can carry the garment bag in a conventional manner. Closures on the garment bag carrier permit the handles and strap of the garment bag to be inserted into the garment bag carrier to permit the garment bag carrier to be used like a conventional suitcase when transferring the garment bag carrier from one destination to another.

U.S. Pat. No. 3,963,102 to Carp discloses a carry-on luggage bag having a housing of flexible material including side, end and bottom walls with top closure flaps interconnected by a zipper. An elongated liner of U shape is mounted upon and spans the side walls, with the bottom wall of the liner spaced from the housing bottom wall to define an auxiliary storage chamber. One side wall is cut away adjacent the auxiliary chamber defining a side flap closed by a zipper. An upright divider is mounted upon the liner bottom wall defining a first storage chamber, adapted to receive, store and enclose a tote bag. The tote bag includes a housing of flexible material having side, end and bottom walls, top closure flaps and a zipper interconnecting the flaps. An elongated liner of U shape is mounted upon and spans the tote bag side walls, with the bottom of the liner spaced from the tote bag bottom wall to define an auxiliary storage chamber. One side wall of the tote bag is longitudinally slit adjacent the latter storage chamber, closed by a zipper. An umbrella storage tube is suspended within the tote bag auxiliary chamber. One tote bag end wall has a slit portion, with a zipper closure. An upright divider is mounted upon the tote bag liner bottom wall, defining a storage chamber adapted to receive and store and enclose an article storage clutch bag. The clutch bag includes a housing of flexible material having side, end and bottom walls, top closure flaps and a zipper interconnecting the flaps. An upright divider is provided upon the bottom wall of said clutch bag. A first series of article storage pockets is arranged upon the inner surface of the clutch bag one side wall. A second series of article storage pockets is arranged upon the inner surface of the clutch bag other side wall. Third and fourth series of article storage pockets are provided upon opposite sides of the latter divider.

U.S. Pat. No. 5,515,954 to Nordstrom discloses a suitcase having an extendable handle movable between extended and retracted positions, and wheels whereby the suitcase is tilted for transport on the wheels and manipulated via the handle. In one embodiment, a removable garment bag is mounted inside the suitcase. The garment bag has no hanger but has an opening for hangars of the contained garments to extend outside the bag.

U.S. Pat. No. 4,598,803 to Ghiassi discloses a garment bag having carry handles centrally disposed on the outer surface and a carry strap that is snap connected to eyelets for shoulder carry. Eyelets are centrally disposed on opposite sides of the interior surface thereof and may be used for snap-hook attachment of a utility kit. A pair of bottom straps and a pair of side straps may be employed to embrace a carry-on bag that is designed to fit within the arc formed when the garment bag is folded over. The strap lengths are adjustable, and the shoulder strap used for the garment bag may be removed and attached to eyelets at each end of the carry-on bag, thus permitting shoulder carry of the carry-on bag.

U.S. Pat. No. 4,206,835 to Shapiro discloses a flexible garment bag and a carrying case constructed to enable their separable connection to one another so that the assembly may be carried as a compact unit. The garment bag has first and second panels of flexible material connected to one another at their edges, the first panel having a longitudinally extending opening provided with a closure. The carrying case has a bottom wall, side walls, end walls and a top wall, the top wall having a handle. The carrying case has a length substantially equal to the width of the garment bag, and the garment bag has a length sufficient to substantially cover the bottom wall and the side walls of the carrying case in the assembled relationship of the garment bag and carrying case. A connector is secured to the carrying case, and longitudinally spaced connectors are secured to the second panel to extend from each end of the garment bag for separable connection to the connector secured to the carrying case.

While many attempts have been made to combine various types of luggage, including a luggage bag and a garment bag, all have failed to provide an easy way to install and remove a garment bag from a luggage bag.

SUMMARY OF THE INVENTION

It is therefore an object of the invention to provide a combination garment bag and luggage bag.

It is also an object of the invention to provide a combination garment bag and luggage bag which are easy to put together and take apart.

It is another object of the invention to provide a combination garment bag and luggage bag which is easy to pack and unpack.

Certain of the foregoing and related objects are attained according to the present invention by the provision of a combination luggage bag and garment bag, comprising a relatively rigid outer luggage bag and a relatively flexible inner garment bag, wherein the outer luggage bag and the inner garment bag are provided with mating releasable coupling means for releasably coupling the inner garment bag to the outer luggage bag and for quickly releasing the inner garment bag from the outer luggage bag.

Preferably, the mating coupling means including a slider and a track and the slider is coupled to the top of the garment bag and the track is coupled to the bottom of the luggage bag. Most desirably, this outer luggage bag is provided with wheels. Most advantageously, the garment bag has an expandable hanger bar. The hanger bar may be spring loaded and the hanger bar is coupled to two hanging hooks. The hooks are preferably arranged at opposite ends of the hanger bar.

In a particular preferred embodiment, the garment bag comprises a front panel, a rear panel and at least one pair of releasable straps for releasbly joining the sides of the front panel to the rear panel. Most desirably, the luggage bag has a top side, a front side, a bottom side and a rear side, and a zipper which is positioned along the bag such that, upon opening the zipper, the top side and the front side can be pivoted to a position which lie generally flat and generally in alignment with the rear side to allow easy access to the garment bag.

DETAILED DESCRIPTION

Figure 1:
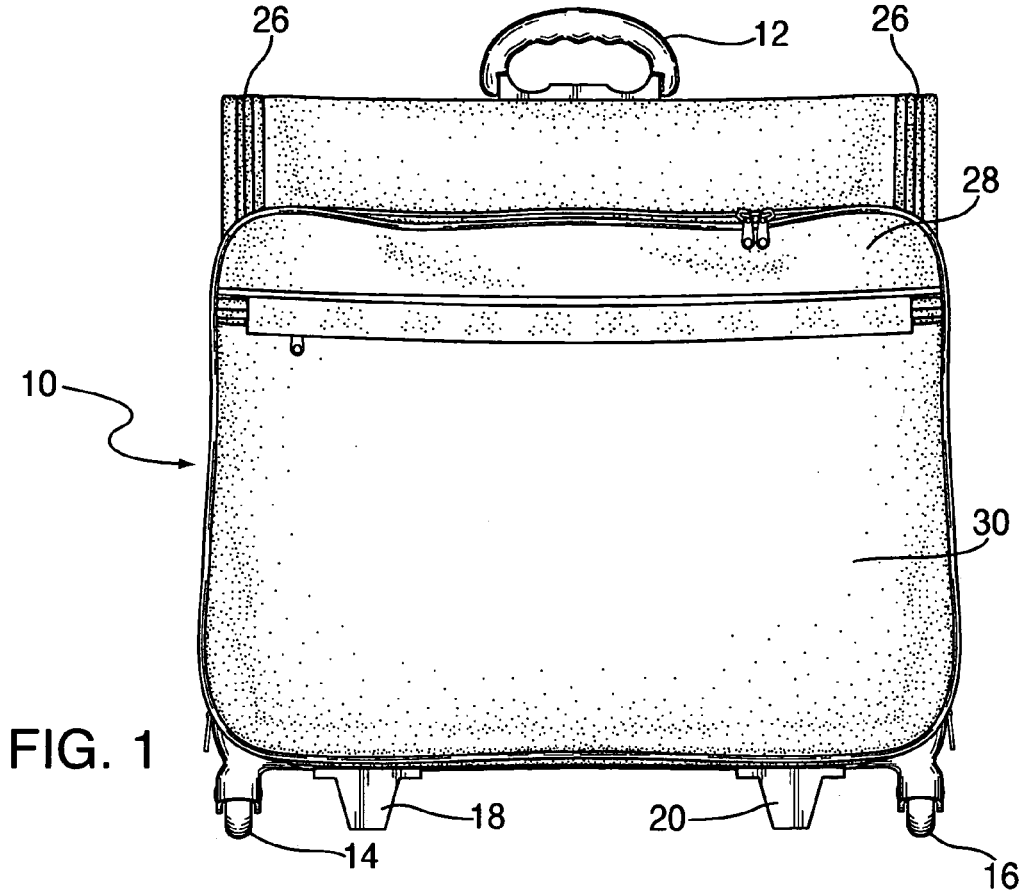
FIG. 1 is a side elevation view of the front of the luggage bag according to the invention.
Figure 2:
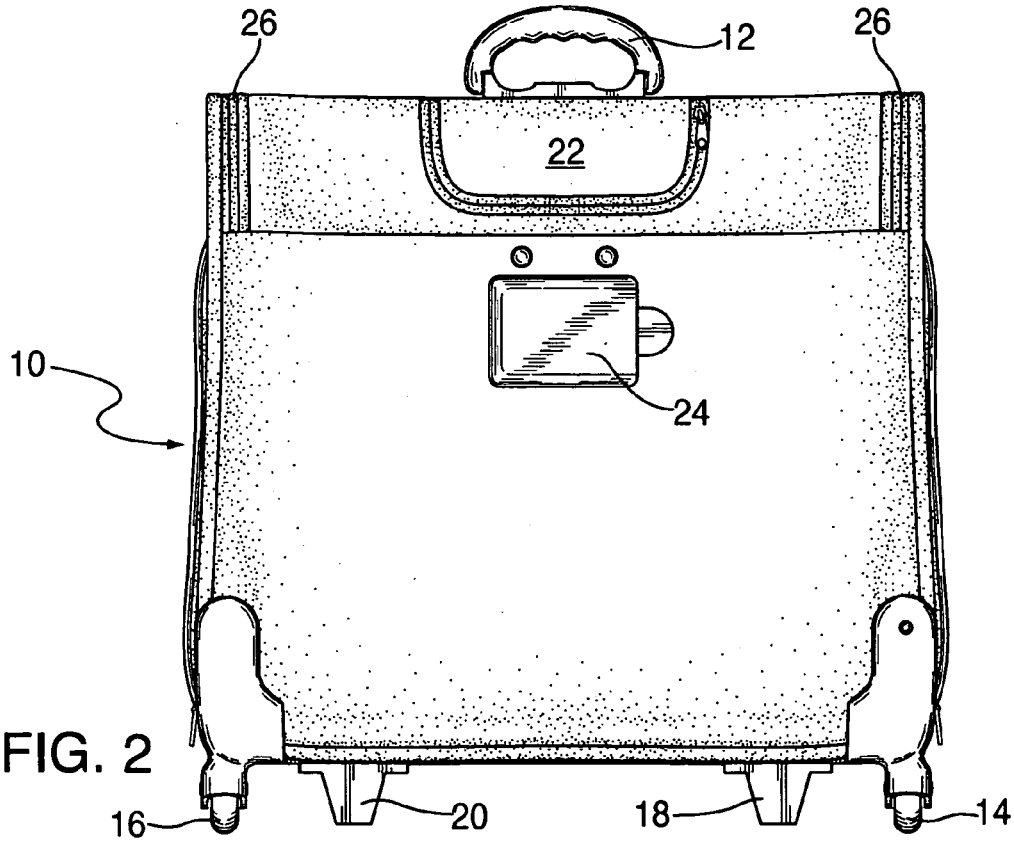
FIG. 2 is a side elevation view of the back of the luggage bag according to the invention.
Figure 3:
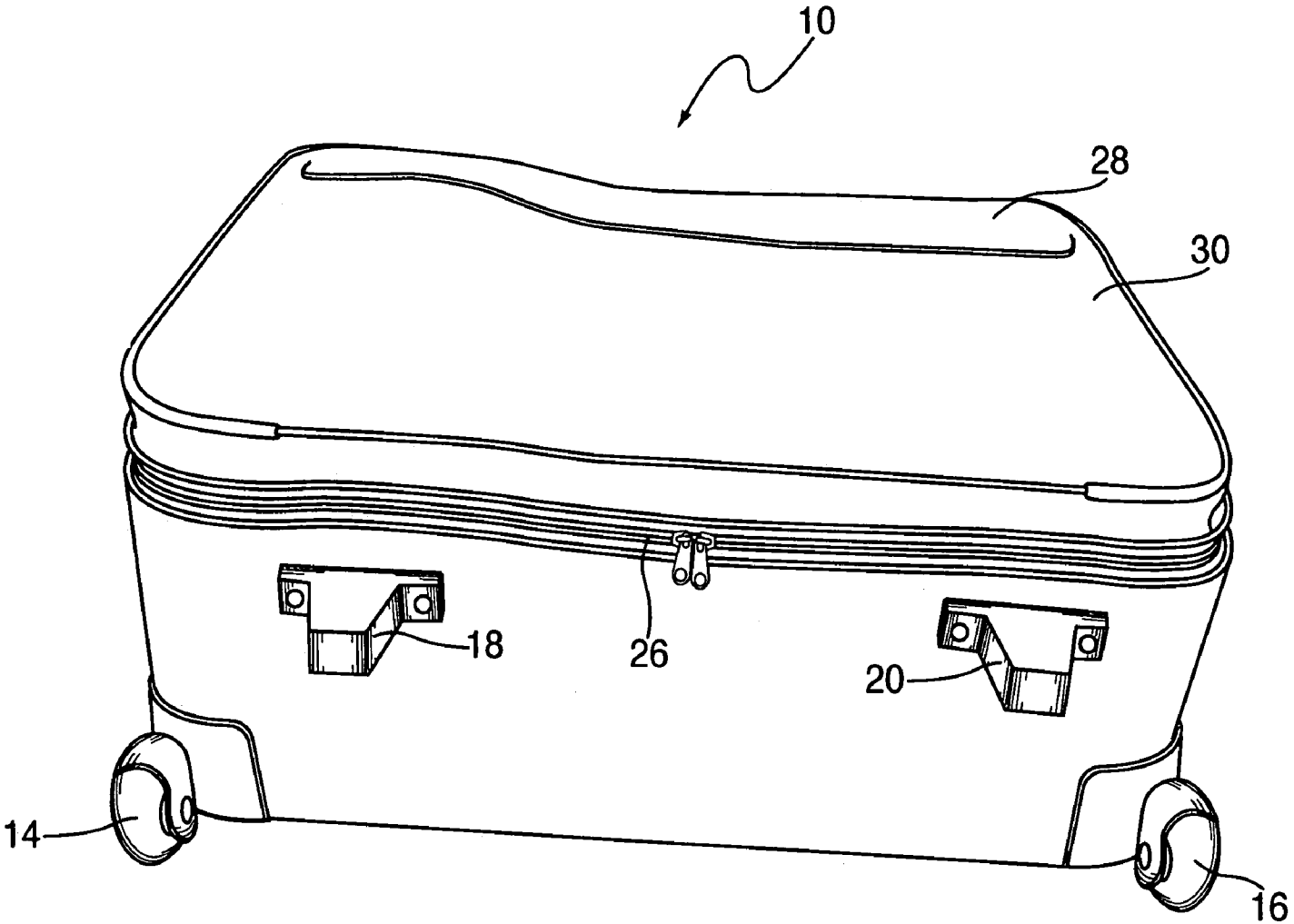
FIG. 3 is a perspective view of the bottom of the luggage bag.
Figure 4:
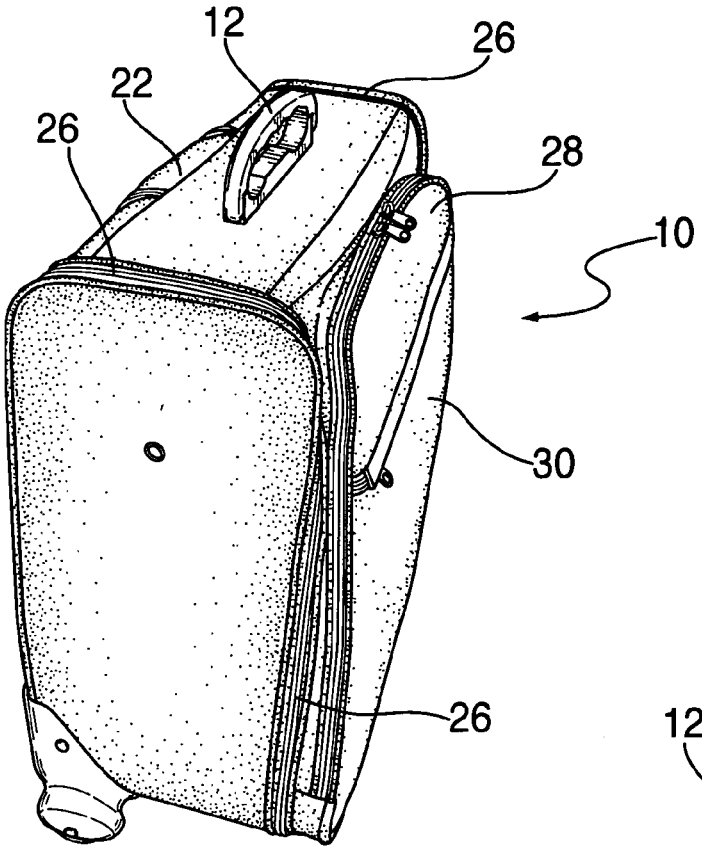
FIG. 4 is a perspective view of the top and lateral end of the luggage bag.
Figure 5:
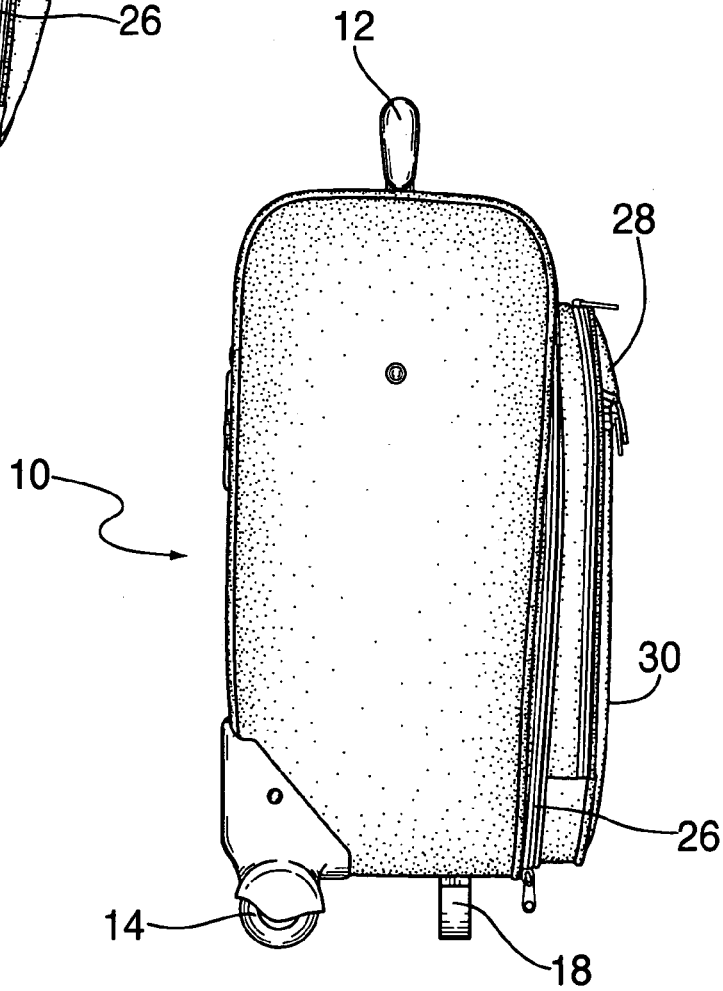
FIG. 5 is a side elevation view of the luggage bag.
Figure 6:
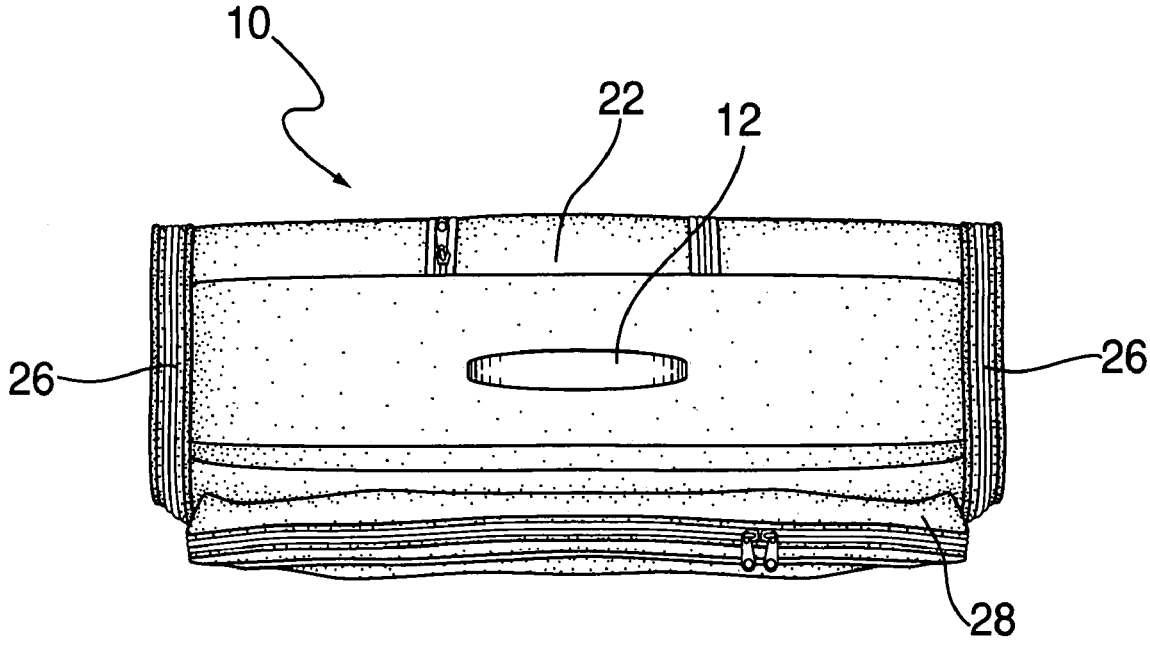
FIG. 6 is a top plan view of the luggage bag.

Turning now to FIGS. 1–6, a luggage bag 10 according to the invention is a substantially rectilinear and substantially rigid structure having a handle 12 at one end. The end opposite the handle 12 is provided with a pair of wheels 14, 16 at the back and a pair of feet 18, 20 near the front. A zippered compartment 22 is located on the back adjacent to the handle 12 (FIG. 2). The compartment contains a telescoping tether (not shown) for dragging the luggage on its wheels. Below the compartment 22, an ID card sleeve 24 is provided. A main zipper 26 extends along the bottom of the bag (FIG. 3) and up the sides 26, twisting around to the front of the bag (FIG. 4), over the top of the bag (FIG. 6), and terminating on the back of the bag above the ID sleeve 24 (FIG. 2). According to the illustrated embodiment, the front of the bag is provided with two zippered pouches 28, 30.

Figure 7:
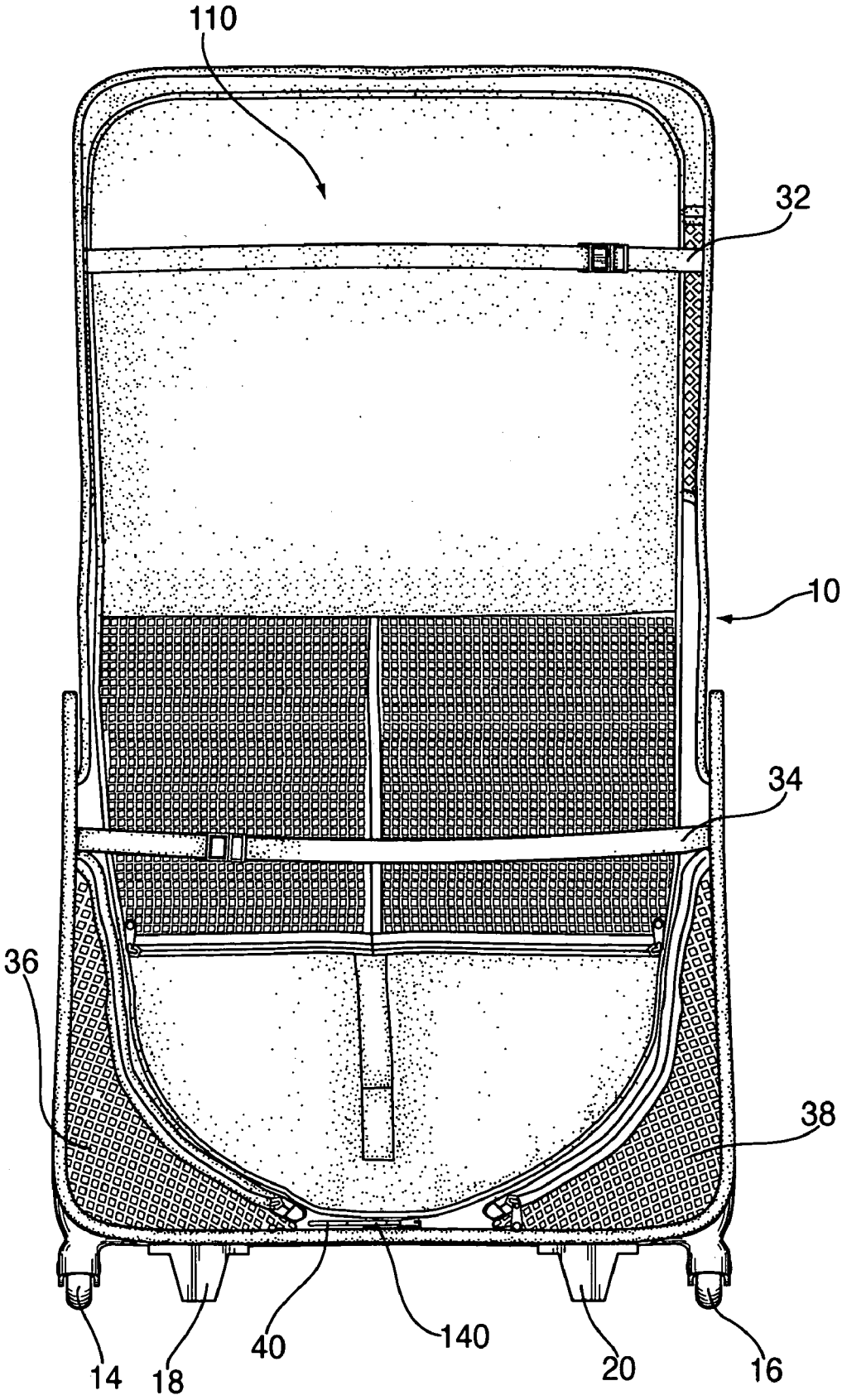
FIG. 7 is a side elevation view of the luggage bag opened and exposing the garment bag.
Figure 8:
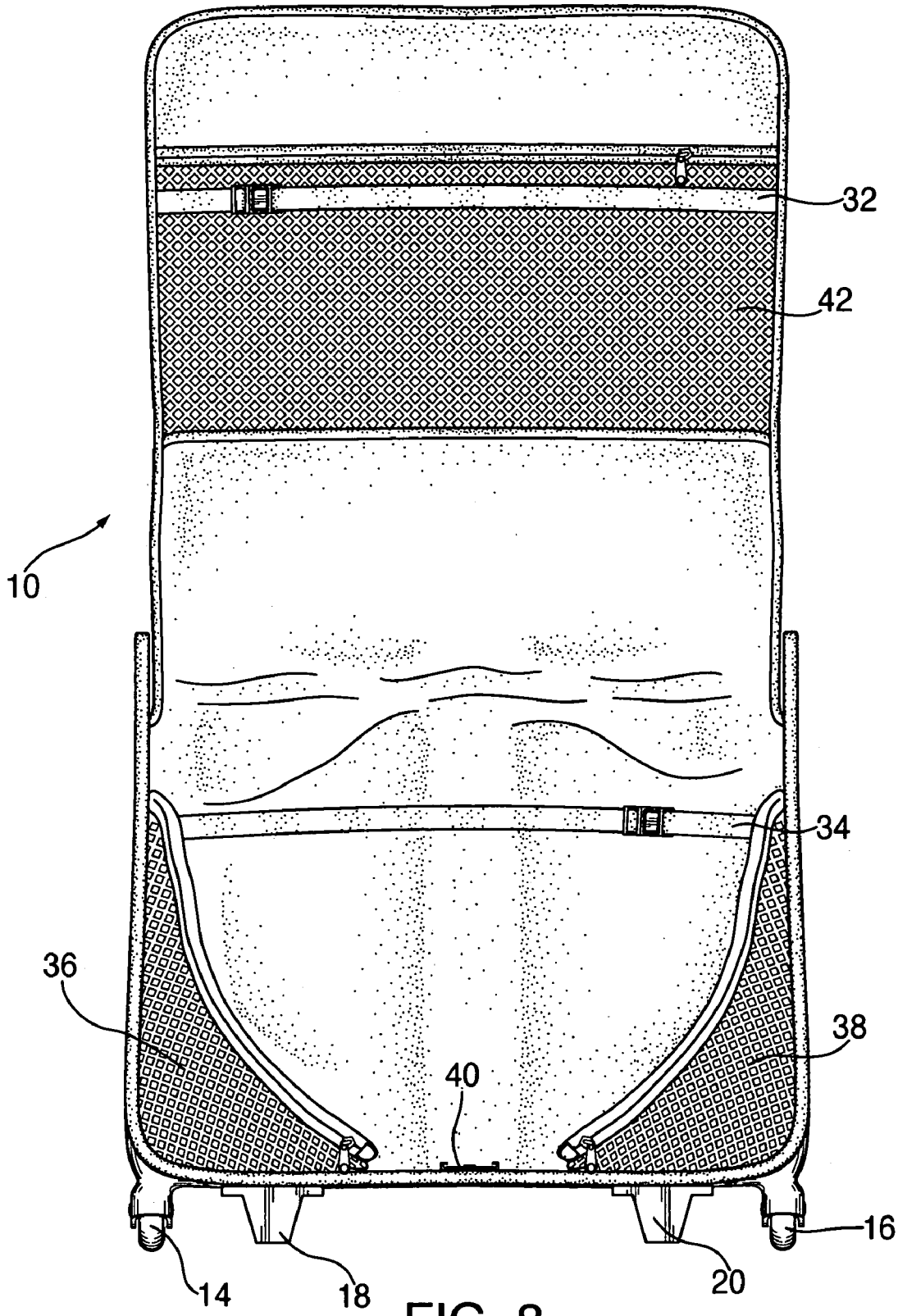
FIG. 8 is a side elevation view of the luggage bag opened with the garment bag removed.

When the main zipper 26 is unzipped, the garment bag 10 can be opened so that the front and top sides of the bag can be pivoted to a position in which they lie generally flat and substantially in alignment with the rear side of the bag to allow for full and easy access to the interior of the bag and a removable garment bag 110 as shown in FIGS. 7 and 8. The interior of the bag 10 includes a pair of spaced apart horizontal straps 32, 34 which hold the garment bag 110 in place. Two substantially triangular zippered mesh pockets 36, 38 are provided at the bottom of the bag. Releasable coupling means in the form of a sliding clip mechanism 40, 140 is located between these pockets. When the garment bag is removed as shown in FIG. 8, a third zippered mesh pocket 42 is revealed.

Figure 9:
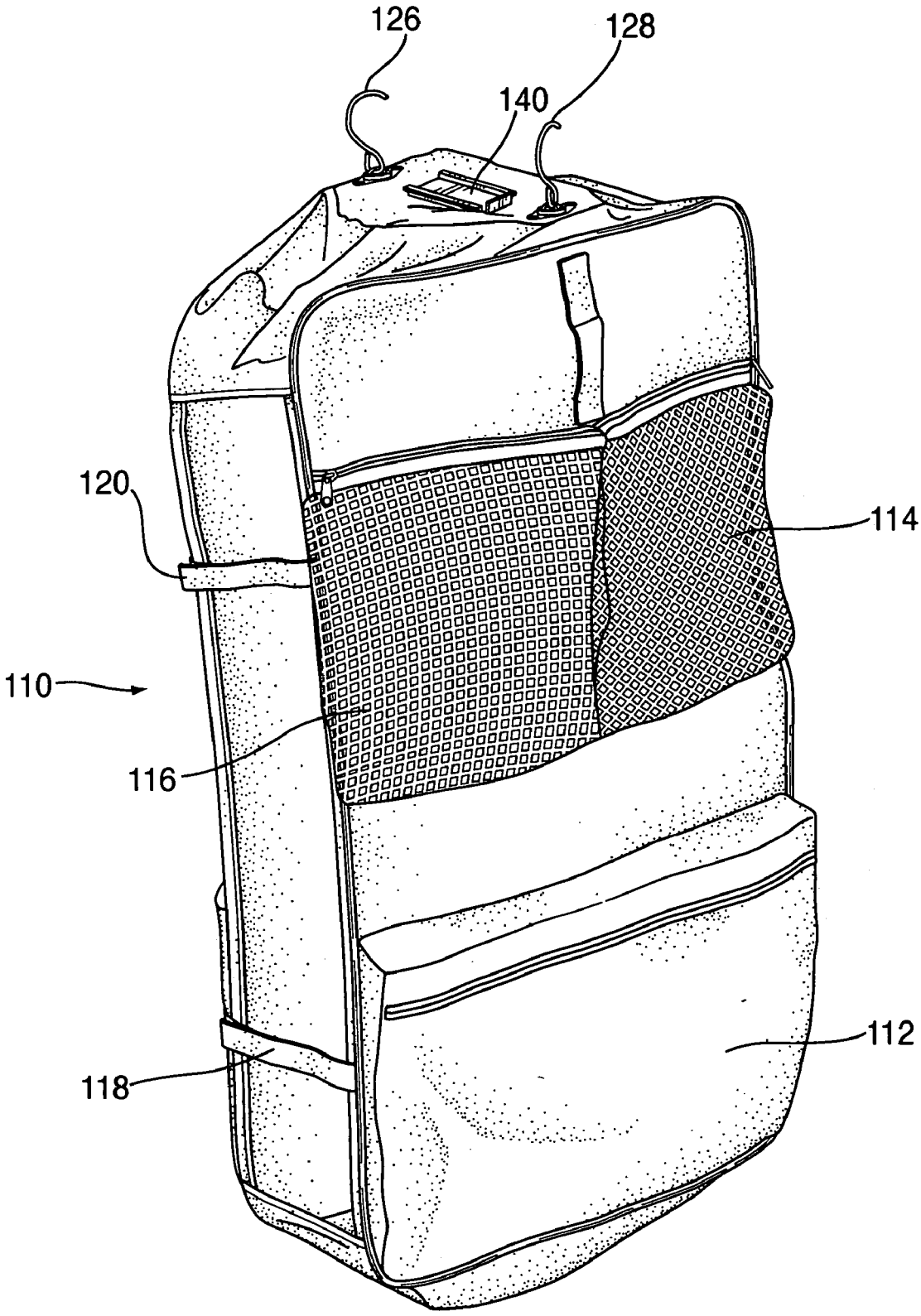
FIGS. 9 and 10 are perspective views of the garment bag removed from the luggage bag.
Figure 10:
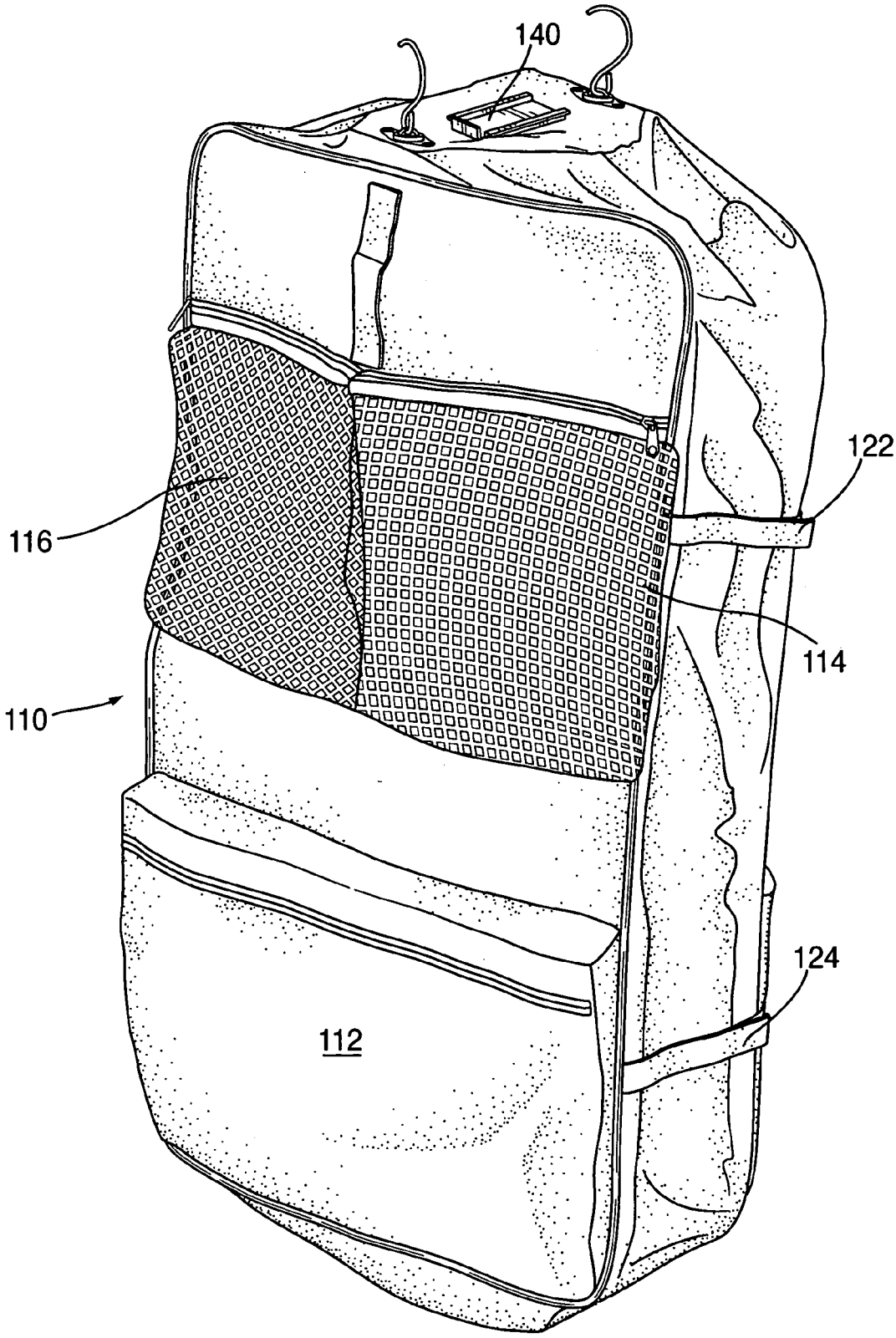
Figure 11:
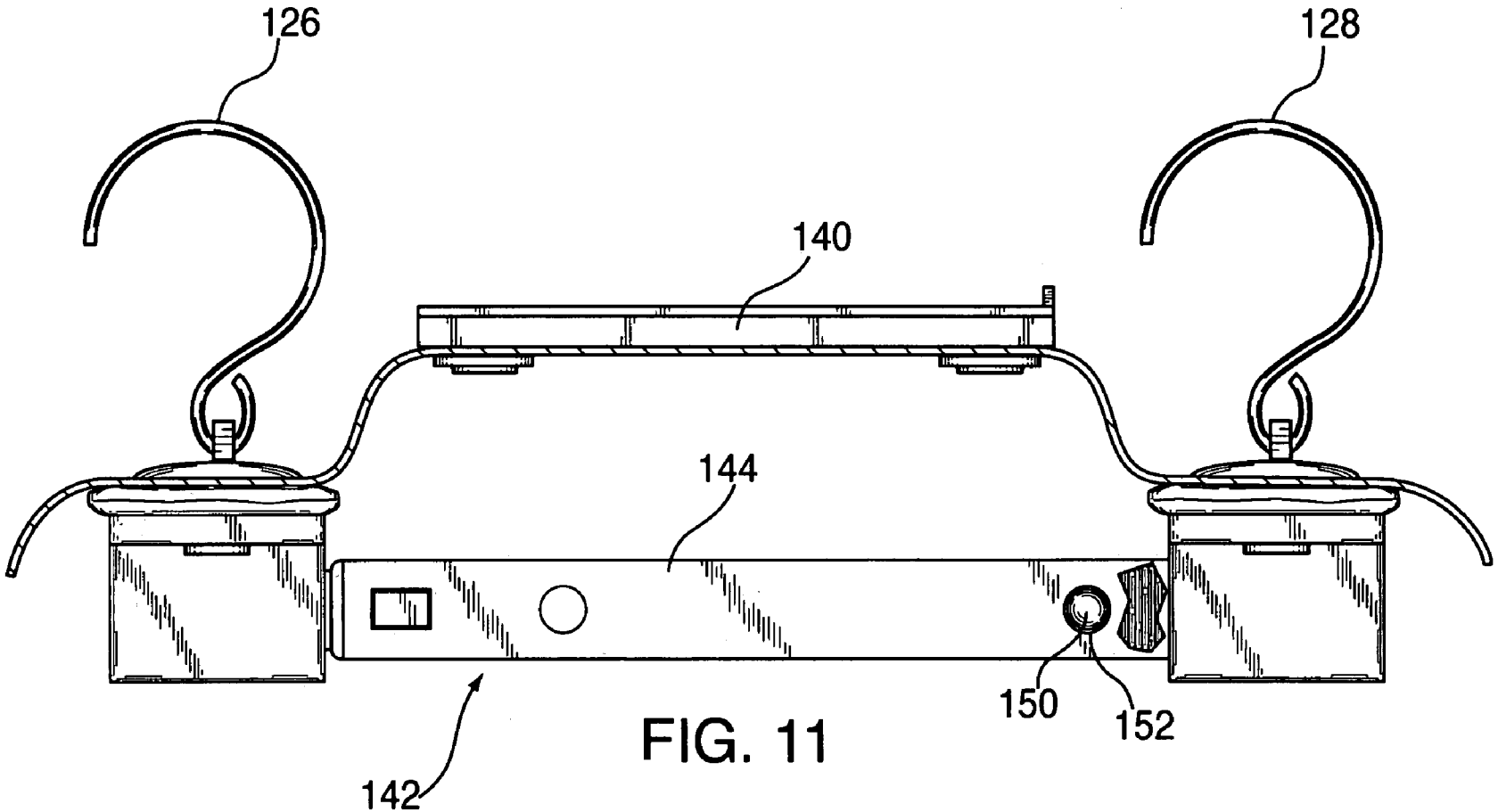
FIG. 11 is a broken sectional view illustrating the hanger bar in a compressed state.
Figure 12:
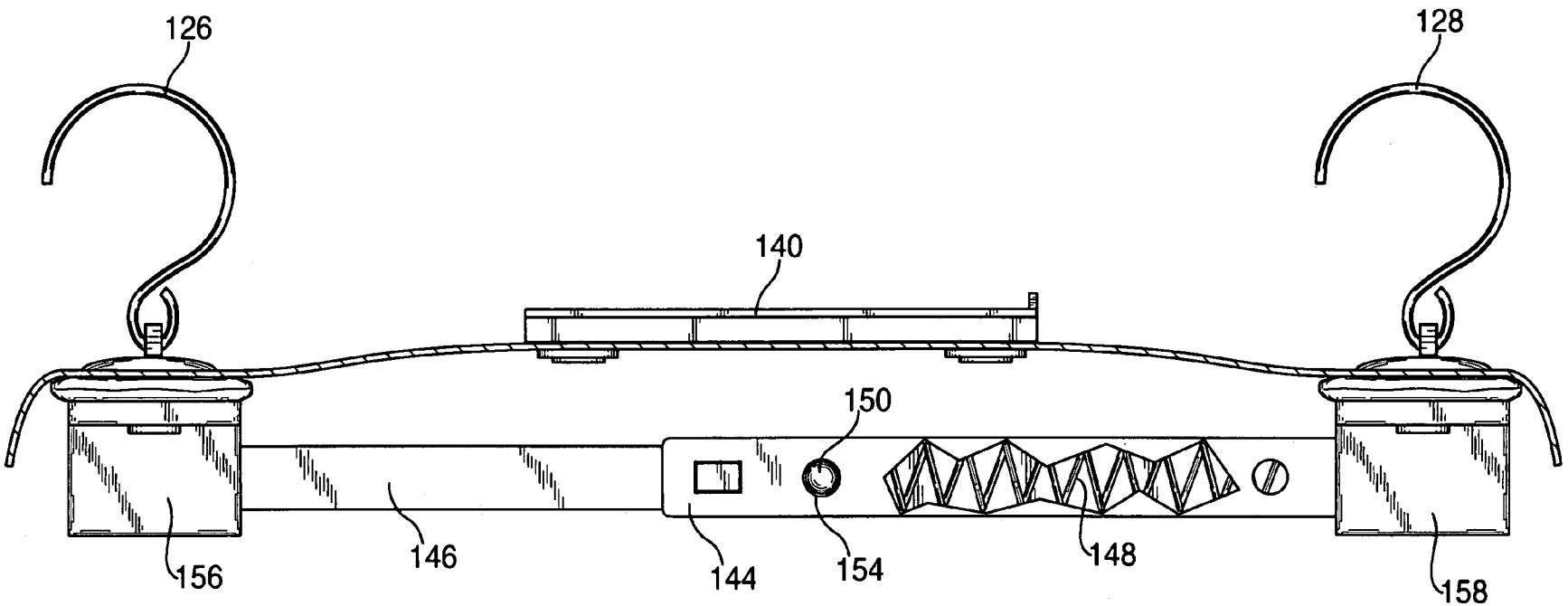
FIG. 12 is a broken sectional view illustrating the hangar bar in an expanded state.
Figure 13:
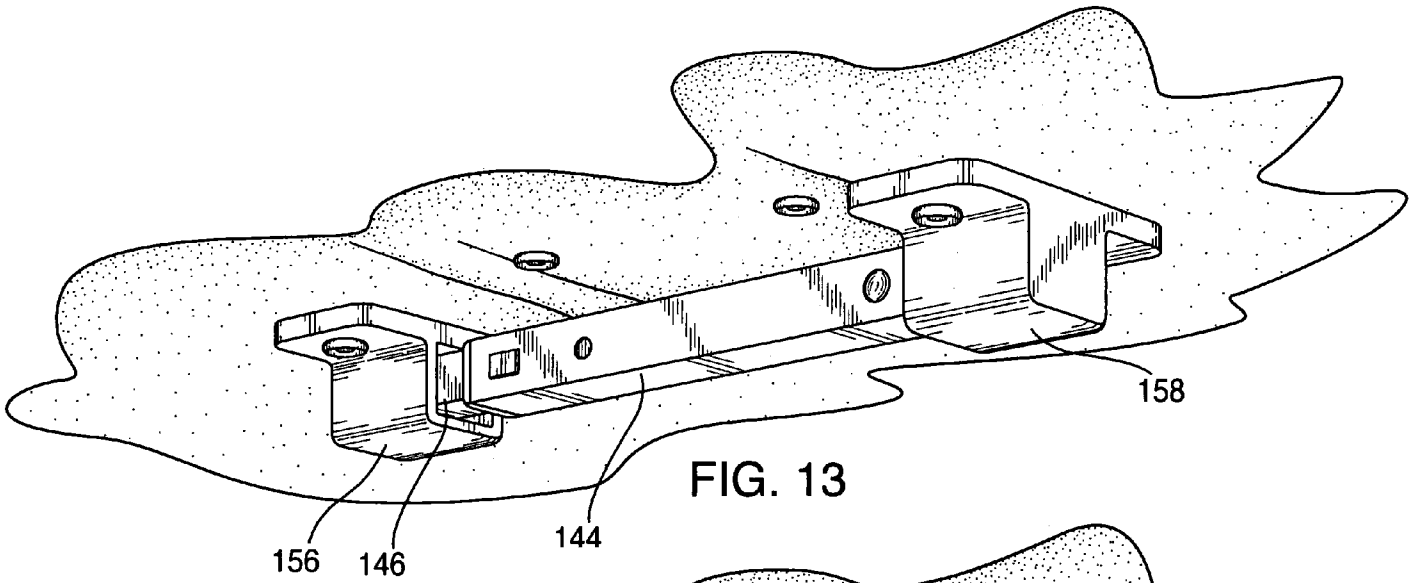
FIG. 13 is a broken perspective view illustrating the hanger bar in a compressed state.
Figure 14:
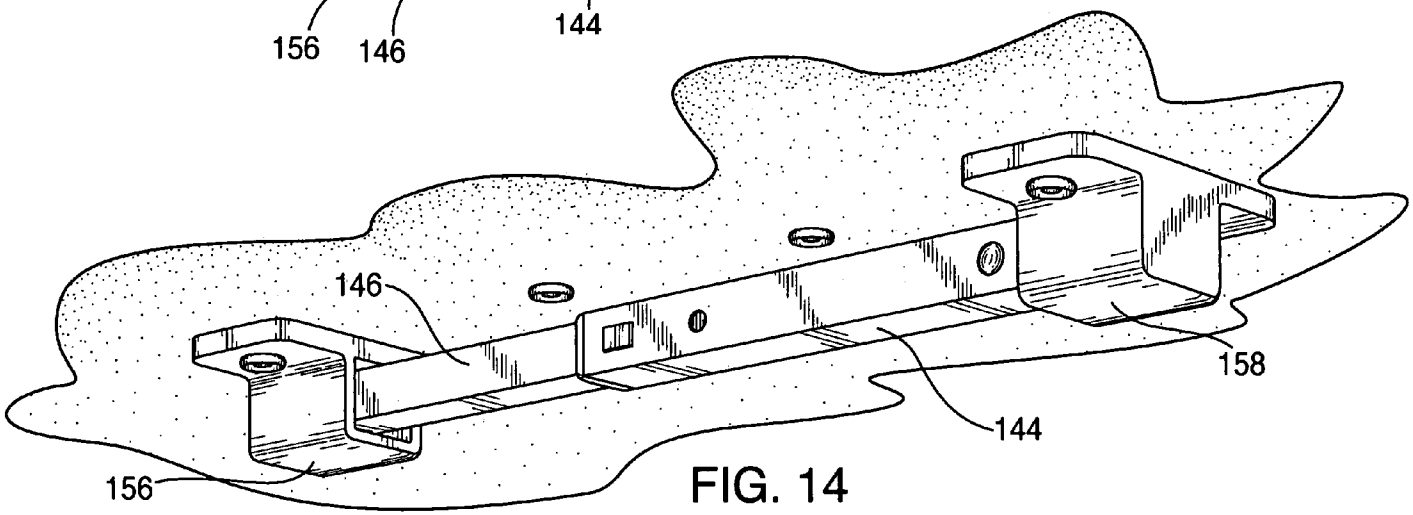
FIG. 14 is a broken perspective view illustrating the hanger bar in an expanded state.

Referring now to FIGS. 9 and 10, the garment bag 110 is illustrated in greater detail. The bag 110 has three zippered front pockets 112, 114, and 116. In the illustrated embodiment, the pockets 114, 116 are mesh. The left side of the bag has two spaced apart releasable Velcro® hook and loop mechanical fastening straps 118, 120 and the right side has a similar pair of releasable Velcro straps 122, 124. Two hooks 126, 128 are provided on the top of the bag on either side of the clip mechanism 140. A careful viewing of FIG. 9 shows that the left side of the bag is open without a side panel beneath straps 118, 120. This allows easy access to the interior of the bag.

FIGS. 11–14 illustrate the expandable hanger bar 142. The hanger bar 142 has two telescoping rods 144, 146 which are spring biased to the expanded position shown in FIGS. 12 and 14 by a coil spring 148. The bar is held in the compressed position shown in FIGS. 11 and 10 by a spring-loaded ball bearing 150 which is coupled to the rod 146 and which engages a hole 152 in the rod 144. When the rods are in the expanded position shown in FIGS. 12 and 14, the bearing 150 engages the hole 154 in rod 144. From the foregoing, it will be appreciated that the hangar bar 142 is moved from the compressed position to the expanded position by pressing the ball bearing 150 out of engagement with the hole 152. It is moved from the expanded position to the compressed position by pressing the ball bearing 150 out of engagement with the hole 154 and by pushing the rods together. As shown in the figures, the end of rod 146 is coupled to a mounting block 156 and the end of the rod 144 is coupled to a mounting block 158. These mounting blocks are coupled (through the fabric of the garment bag) to the hooks 126, 128 respectively. As can be appreciated, garments can be easily hung on, or removed from, the hanger bar 142 when in its expanded state and then the bar can be compressed when the garment bag is fitted into the luggage bag.

Figure 15:
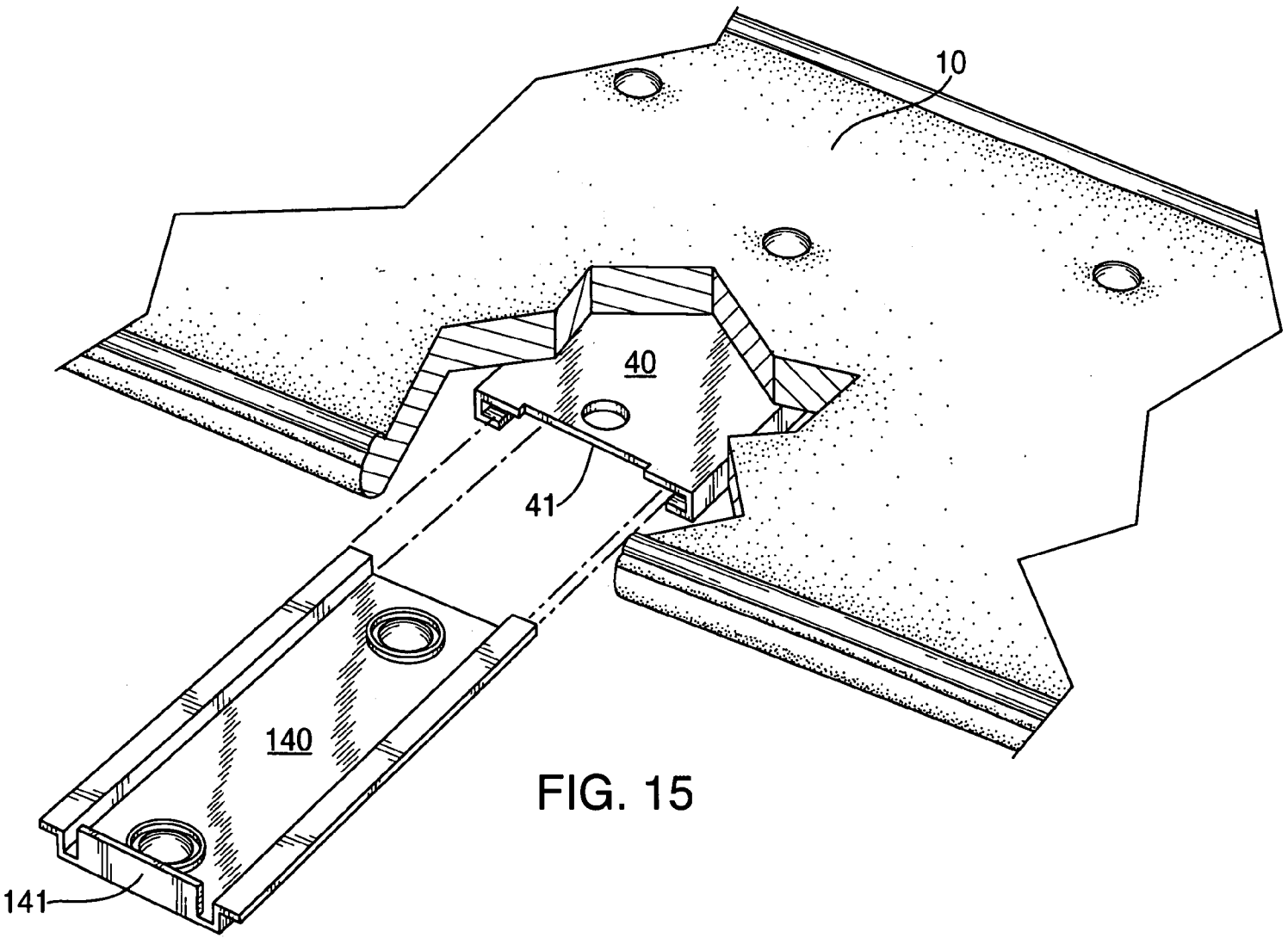
FIG. 15 is a broken perspective view illustrating the coupling mechanism in an uncoupled state.
Figure 16:
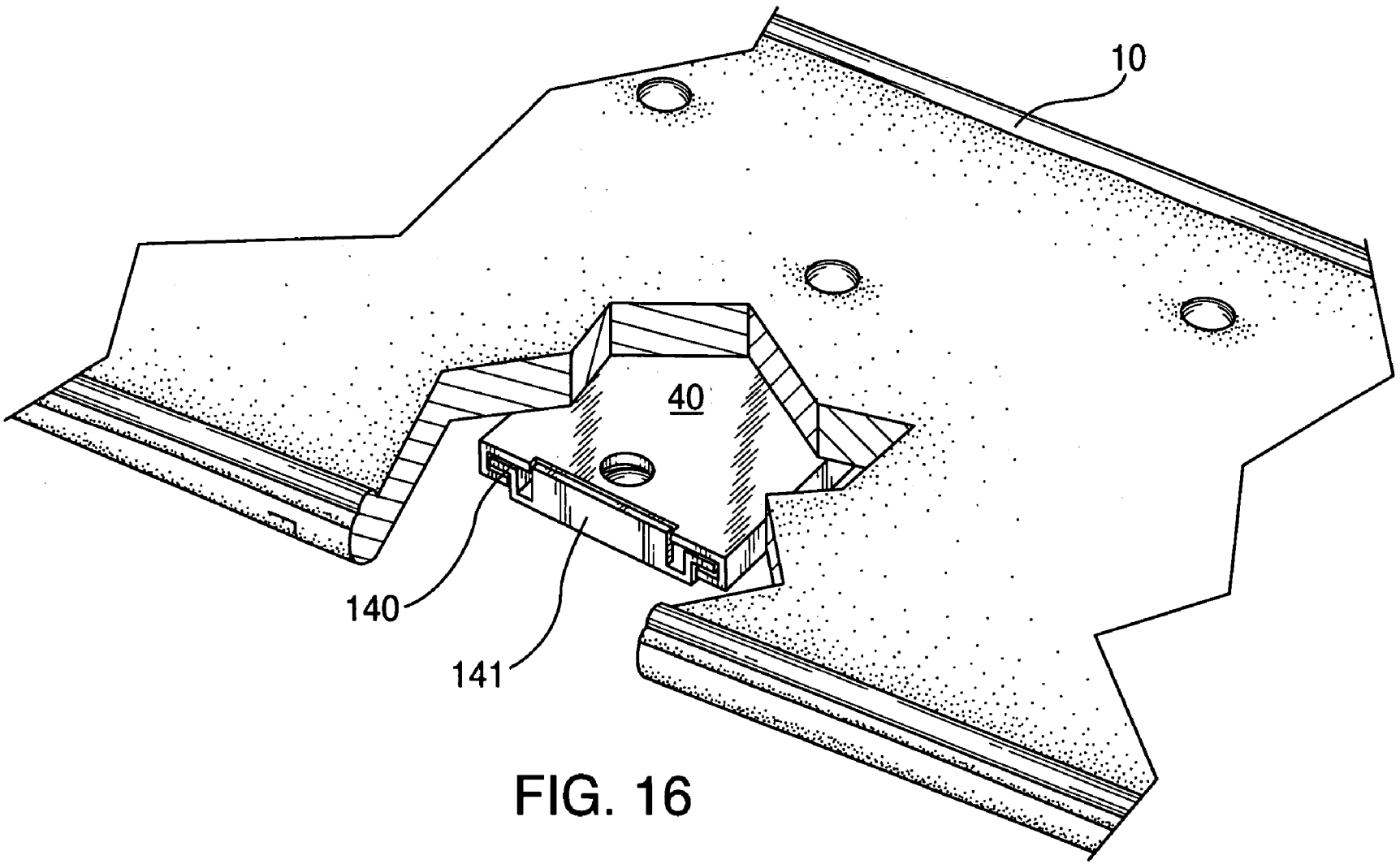
FIG. 16 is a broken perspective view illustrating the coupling mechanism in a coupled state.

FIGS. 15 and 16 illustrate the sliding clip mechanism 40, 140 which couples the garment bag to the luggage bag. As illustrated, the clip mechanism includes a track 40 into which slider 140 engages. Track 40 has a recessed edge 41 on one end thereof which engages flange 141 on slider 140 to limit inward sliding of slider 141. It will be appreciated, however, that these parts could be reversed.

There have been described and illustrated herein a combination luggage bag and garment bag. While particular embodiments of the invention have been described, it is not intended that the invention be limited thereto, as it is intended that the invention be as broad in scope as the art will allow and that the specification be read likewise. For example, although the releasable coupling means is advantageous in the form of the preferred track and sliding clip mechanism, other slide and/or coupling mechanisms could be employed. In addition, although the Velcro® straps are preferably used to releasably secure the front and rear panel of the garment bag, other releasable fastening means, e.g., buckled straps, straps with snaps etc., could be employed. It will therefore be appreciated by those skilled in the art that yet other modifications could be made to the provided invention without deviating from its spirit and scope as so claimed.

What is claimed is:

1. A combination luggage bag and garment bag, comprising:

a relatively rigid outer luggage bag having a bottom which may be opened and closed; and a relatively flexible inner garment bag removably disposed within said outer luggage bag in a folded manner when said outer luggage bag is closed, said inner garment bag comprising a front panel, a rear panel and a top panel connecting said front and rear panels, wherein said outer luggage bag and said inner garment bag are provided with mating releasable coupling means for releasably coupling said inner garment bag to said outer luggage bag and for quickly releasing said inner garment bag from said outer luggage bag, and wherein said inner garment bag has an expandable hanger bar disposed beneath said top panel and means for coupling said expandable hanger bar to said top panel and wherein said inner garment bag also has hanger means for hanging said inner garment bag when it is removed from said outer luggage bag, said expandable hanger bar being movable between an expanded position to permit facile hanging of garments and a compressed position to permit said garment bag to be fitted into said luggage bag, said hanger bar in said compressed position serving to compress said top panel and, in turn, draw said front and rear panels closer together.

2. A combination luggage bag and garment bag according to claim 1, wherein said mating coupling means including a slider and a track.

3. A combination luggage bag and garment bag according to claim 2, wherein:

said slider is coupled to said top panel of said garment bag and said track is coupled to said bottom of said luggage bag.

4. A combination luggage bag and garment bag according to claim 1, wherein:

said outer luggage bag is provided with wheels.

5. A combination luggage bag and garment bag according to claim 1, wherein:

said expandable hanger bar is spring loaded.

6. A combination luggage bag and garment bag according to claim 1, wherein:

said hanger means comprises a pair of spaced-apart hooks and said expandable hanger bar is coupled to said pair of hooks.

7. A combination luggage bag and garment bag according to claim 6, wherein said pair of hooks are disposed above said top panel, and wherein said hooks and said expandable hanger bar are coupled to one another through said top panel.

8. A combination luggage bag and garment bag according to claim 6, wherein:

said pair of hooks are arranged at opposite ends of said expandable hanger bar.

9. A combination luggage bag and garment bag according to claim 1, wherein said front panel and said rear panel have sides and wherein said garment bag comprises at least one pair of releasable straps for releasably joining said sides of said front panel to said rear panel.

10. A combination luggage bag and garment bag according to claim 1, wherein said luggage bag has a top side, a front side, a bottom side and a rear side, and a zipper which is positioned along said luggage bag such that, upon opening said zipper, said top side and said front side can be pivoted to a position which lie generally flat and generally in alignment with said rear side to allow easy access to said garment bag.

11. A combination luggage bag and garment bag, comprising:

a relatively rigid outer luggage bag having a bottom which may be opened and closed; and a relatively flexible inner garment bag removably disposed within said outer luggage bag in a folded manner when said outer luggage bag is closed, wherein said outer luggage bag and said inner garment bag are provided with mating releasable coupling means for releasably coupling said inner garment bag to said outer luggage bag and for quickly releasing said inner garment bag from said outer luggage bag, and wherein said inner garment bag has an expandable hanger bar and has hanger means for hanging said inner garment bag when it is removed from said outer luggage bag, wherein said hanger means comprises a pair of spaced-apart hooks and said expandable hanger bar is coupled to said pair of hooks; and wherein said garment bag has a top panel and wherein said pair of hooks are disposed above said top panel, and said hanger bar is disposed below said top panel, and wherein said hooks and hanger bar are coupled to one another through said top panel.

12. A combination luggage bag and garment bag according to claim 11, wherein said mating coupling means including a slider and a track.

13. A combination luggage bag and garment bag according to claim 12, wherein:

said slider is coupled to said top panel of said garment bag and said track is coupled to said bottom of said luggage bag.

14. A combination luggage bag and garment bag according to claim 11, wherein:

said outer luggage bag is provided with wheels.

15. A combination luggage bag and garment bag according to claim 11, wherein:

said expandable hanger bar is spring loaded.

16. A combination luggage bag and garment bag according to claim 11, wherein:

said pair of hooks are arranged at opposite ends of said expandable hanger bar.

17. A combination luggage bag and garment bag according to claim 11, wherein said garment bag comprising a front panel, and a rear panel having sides and at least one pair of releasable straps for releasably joining said sides of said front panel to said rear panel.

18. A combination luggage bag and garment bag according to claim 11, wherein said luggage bag has a top side, a front side, a bottom side and a rear side, and a zipper which is positioned along said bag such that, upon opening said zipper, said top side and said front side can be pivoted to a position which lie generally flat and generally in alignment with said rear side to allow easy access to said garment bag.

* * * * *